US008721171B2

(12) United States Patent
Tsuji et al.

(10) Patent No.: US 8,721,171 B2
(45) Date of Patent: May 13, 2014

(54) SWITCH DEVICE AND WRISTWATCH

(71) Applicant: Casio Computer Co., Ltd., Tokyo (JP)

(72) Inventors: Ayako Tsuji, Fuchu (JP); Masato Ueno, Tama (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/707,945

(22) Filed: Dec. 7, 2012

(65) Prior Publication Data

US 2013/0155821 A1 Jun. 20, 2013

(30) Foreign Application Priority Data

Dec. 19, 2011 (JP) ..... 2011-276910

(51) Int. Cl.

| | |
|---|---|
| ***G04B 3/00*** | (2006.01) |
| ***G04B 37/00*** | (2006.01) |
| ***G04B 3/04*** | (2006.01) |
| ***G04B 37/08*** | (2006.01) |

(52) U.S. Cl.

CPC ..... *G04B 3/043* (2013.01); *G04B 37/081* (2013.01)

USPC ..... 368/319

(58) Field of Classification Search

USPC ..... 368/288–290, 319–321; 200/16 R, 16 C, 200/43.11, 43.13, 178, 179, 537, 564, 566

See application file for complete search history.

(56) References Cited

U.S. PATENT DOCUMENTS

| | | | | |
|---|---|---|---|---|
| 2,309,428 | A * | 1/1943 | Aegler | 368/288 |
| 7,192,182 | B2 * | 3/2007 | Hiranuma et al. | 368/289 |
| 7,255,473 | B2 | 8/2007 | Hiranuma et al. | |
| 7,357,569 | B2 * | 4/2008 | Yoshikawa | 368/308 |
| 2003/0147312 | A1 * | 8/2003 | Hiranuma et al. | 368/319 |
| 2004/0071049 | A1 * | 4/2004 | Hiranuma et al. | 368/319 |
| 2006/0158964 | A1 | 7/2006 | Hiranuma et al. | |

FOREIGN PATENT DOCUMENTS

| | | | |
|---|---|---|---|
| JP | 2003-222688 | A | 8/2003 |
| JP | 2006-194834 | A | 7/2006 |

OTHER PUBLICATIONS

Japanese Office Action dated Sep. 18, 2013 (and English translation thereof) in counterpart Japanese Application No. 2011-276910.

* cited by examiner

*Primary Examiner* — Vit W Miska

(74) *Attorney, Agent, or Firm* — Holtz, Holtz, Goodman & Chick, PC

(57) ABSTRACT

A switch device of the present invention includes a case having a through hole; a cylindrical member attached to the through hole of the case; and an operating member having a shaft section inserted into the cylindrical member and an operating section provided in an outer end portion of the shaft section, wherein the operating member is provided with an engaging projected section, and has a spring member, wherein the cylindrical member is provided with, in an end portion in an outer direction of the case, a release groove where the engaging projected section is movable in an axial direction, and a restricting projected section which restricts movement to the outer direction of the engaging projected section, wherein the cylindrical member is provided with a lock groove which locks the spring member.

16 Claims, 15 Drawing Sheets

SWITCH DEVICE AND WRISTWATCH

CROSS-REFERENCE TO RELATED APPLICATION

This application is based upon and claims the benefit of priority from the prior Japanese Patent Application No. 2011-276910, filed Dec. 19, 2011, the entire contents of which is incorporated herein by reference.

BACKGROUND OF THE INVENTION

1. Field of the Invention

The present invention relates to a switch device provided with an operating member that can be pulled outward and a wristwatch equipped with this switch device.

2. Description of the Related Art

For example, as described in U.S. Pat. No. 7,255,473, a wristwatch is known, which includes a switch device provided with an operating member, such as a crown, in the wristwatch case that can be pulled outward. This type of switch device is configured so that the time can be changed by pulling outward upon the operating member projected outside from the wristwatch case and rotating the operating member in this state.

This type of switch device is configured such that a winding stem pipe is attached to a through hole in the wristwatch case, a shaft section of the operating member is inserted into the winding stem pipe, and an outer end portion of winding stem pipe is attached to the shaft section of this operating member. In this case, a ring member having a plurality of engaging projected sections are attached to the operating member. Also, the winding stem pipe has a small diameter part attached to a through hole in the wristwatch case and a large diameter part projected to the outside of the wristwatch case. A plurality of lock groove sections that engageably or disengageably lock the engaging projected sections of the ring member are provided on the outer peripheral surface of this large diameter part.

The plurality of lock groove sections include a guide groove for attaching and detaching that detachably guides the engaging projected sections of the ring member from the locking grove sections and moves in the axial direction of the winding stem pipe, a lock groove that restricts and locks the movement of the engaging projected sections of the ring member in the axial direction, and a continuous groove that leads the engaging projected sections of the ring member to either of the guide groove or the lock groove.

Accordingly, when the operating member is locked in this switch device, the engaging projected sections of the ring member are inserted and pushed in the guide groove. The engaging projected sections of the ring member move from the guide groove to the lock grove through the continuous groove, and the operating member rotates in this state. As a result, this lock groove restricts the movement of the engaging projected sections in the axial direction of the winding stem pipe, whereby the operating member is locked in a state of being pushed in.

In addition, in this switch device with the operating member rotated and while pushed inward, the lock of the operating member releases when the operating member is pulled outward. Notably, by feeding the engaging projected sections positioned in the lock groove into this continuous groove from the lock groove, the engaged projected sections fed into this continuous groove move to the guide groove. Then, by releasing the lock of the engaging projected sections from the lock groove, the engaged projected sections of the ring member disengage from the guide groove and move in the axial direction in this state, whereby the operating member is pulled outward and the time can be adjusted.

However, in this kind of switch device, when the lock of the operating member is released and the operating member is pulled outward, the operating member has to be rotated while being pushed inward. Otherwise, the engaging projected sections of the ring member positioned in the lock groove disengage from the lock groove, and the lock for the engaging projected sections cannot be released. Therefore, operation of the operating member is complicated and troublesome. There is a problem in that the operability of the operating member is deficient.

SUMMARY OF THE INVENTION

An object of the present invention is to provide a switch device capable of facilitating a lock release operation and a lock operation and preventing inadvertent rotation of the operating member in a locked state, and a wristwatch equipped with the switch device.

In order to achieve the above-described object, in accordance with one aspect of the present invention, there is provided a switch device comprising: a case having a through hole; a cylindrical member attached to the through hole of the case; and an operating member having a shaft section inserted into the cylindrical member and an operating section provided in an outer end portion of the shaft section, wherein the operating member is provided with an engaging projected section that projects towards an axial center of the operating section, and has a spring member attached that resiliently deforms in a radial direction, wherein the cylindrical member is provided with, in an end portion in an outer direction of the case, a release groove where the engaging projected section is movable in an axial direction, and a restricting projected section which is formed in a position where circumferential direction differs relative to the release groove and restricts movement to the outer direction of the engaging projected section, wherein the cylindrical member is provided with a lock groove which locks the spring member, when the operating member is in a position where movement to the outer direction of the engaging projected section is restricted by the restricting projected section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 9A to FIG. 9C are diagrams showing only the operating member shown in FIG. 7 and FIG. 8, of which FIG. 9A is an enlarged side view thereof, FIG. 9B is an enlarged cross-sectional view taken along line D-D in FIG. 9A, and FIG. 9C is an enlarged cross-sectional view taken along line E-E in FIG. 9B;

FIG. 10A and FIG. 10B are diagrams of the pressing member of the switch device shown in FIG. 2, of which FIG. 10A is an enlarged side view thereof and FIG. 10B is an enlarged cross-sectional view taken along line F-F;

FIG. 11A to FIG. 11C are diagrams of a spring member of the switch device shown in FIG. 2, of which FIG. 11A is an enlarged side view thereof, FIG. 11B is an enlarged front view thereof, and FIG. 11C is an enlarged cross-sectional view taken along line G-G in FIG. 11A;

DETAILED DESCRIPTION OF THE PREFERRED EMBODIMENTS

An embodiment in which the present invention has been applied to a wristwatch will hereinafter be described with reference to FIG. 1 to FIG. 15.

Figure 1:
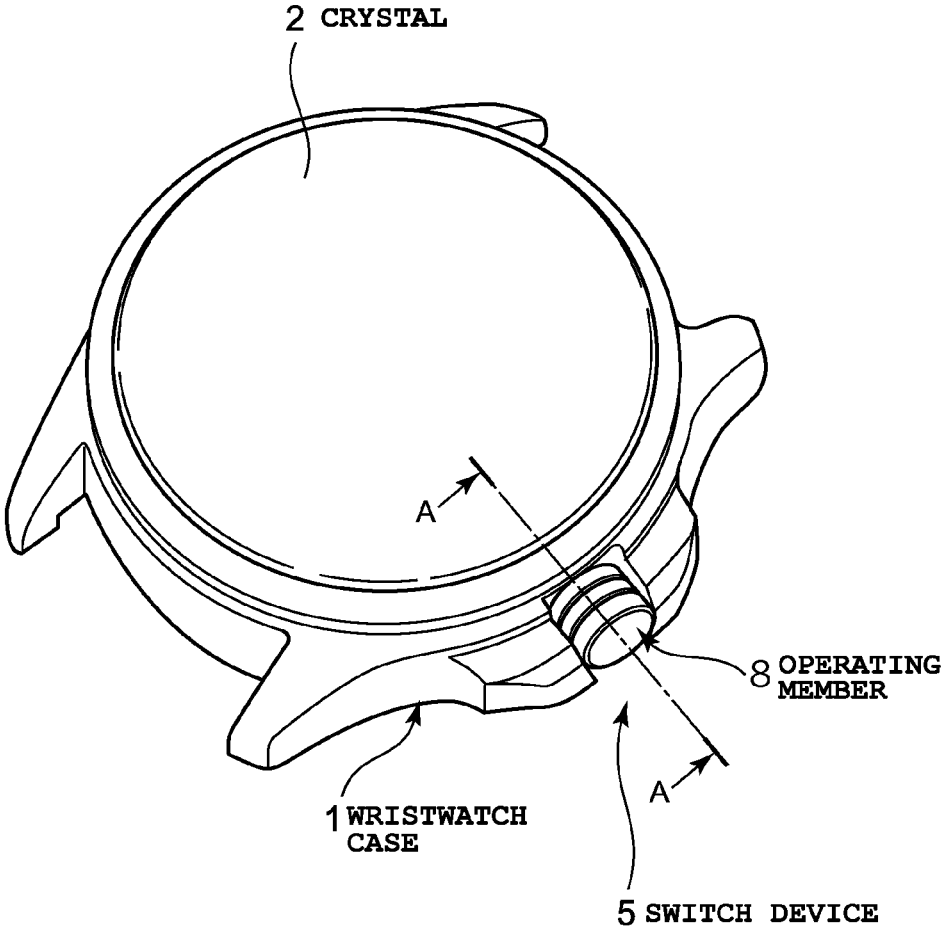
FIG. 1 is a perspective view according to an embodiment in which the present invention is applied to a wristwatch.
Figure 2:
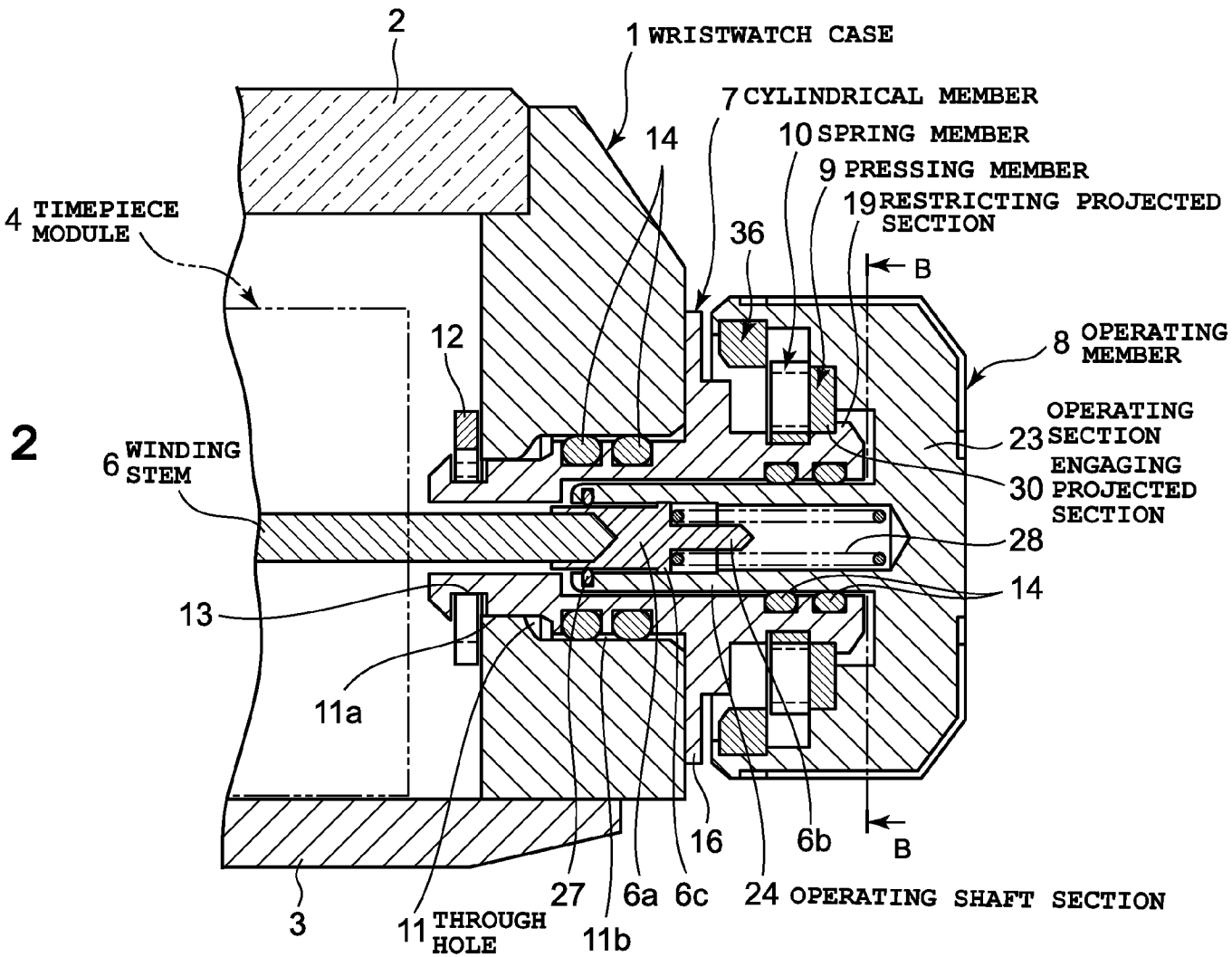
FIG. 2 is an enlarged cross-sectional view of main section of the wristwatch taken along line A-A in FIG. 1.

The wristwatch includes a wristwatch case 1, as shown in FIG. 1 and FIG. 2. A crystal 2 is attached to the upper opening portion of the wristwatch case 1. A back cover 3 (case back) is attached to the underside of the wristwatch case 1.

A timepiece module 4 for displaying the time using hands is provided inside the wristwatch case 1, as shown in FIG. 2. A switch device 5 is provided in a side portion positioned on the 3 o'clock side of the wristwatch case 1, as shown in FIG. 1 and FIG. 2. The switch device 5 is used for switching the operating mode, time adjustment and the like of the timepiece module 4, comprising: a winding stem 6, a cylindrical member 7, an operating member 8, a pressing member 9 and a spring member 10.

In this structure, a through hole 11 that passes through the inside and outside of the wristwatch case 1 is provided in the side portion positioned on the 3 o'clock side of the wristwatch case 1, as shown in FIG. 2. The through hole 11 has a small diameter hole section 11*a* in a square shape positioned on the inner side of the wristwatch case 1 and a large diameter hole section 11*b* in a circular shape positioned on the outer side of the wristwatch case 1. Overall, the through hole 11 is formed in a stepped shape. The cylindrical member 7 of the switch device 5 is inserted into the through hole 11.

Figure 5:
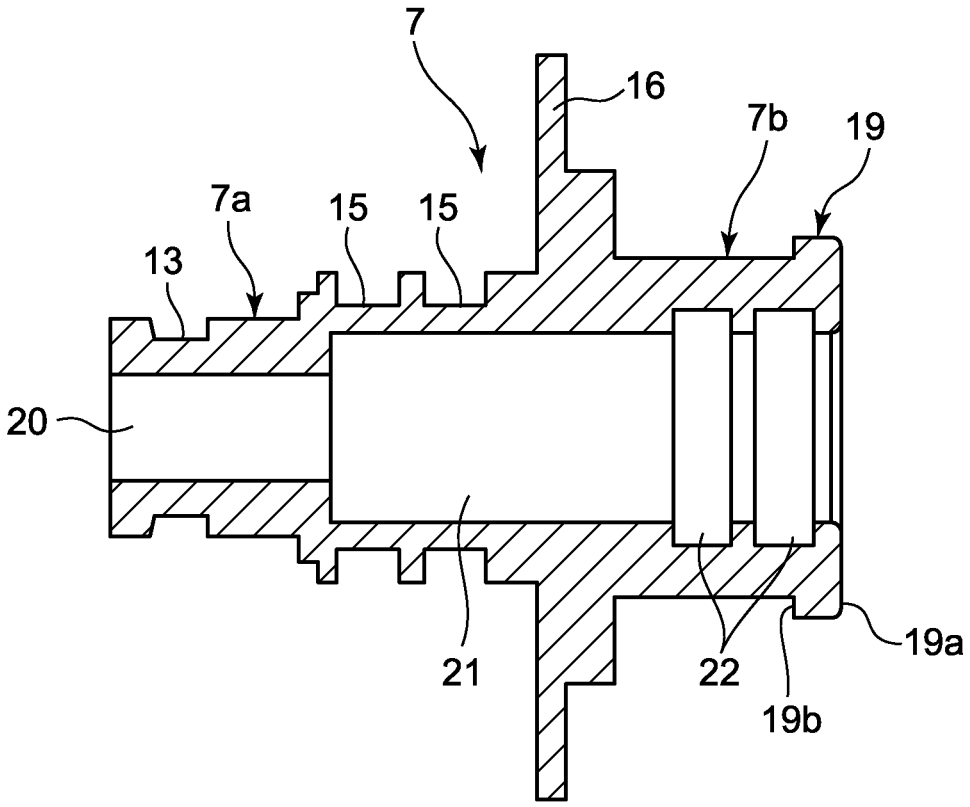
FIG. 5 is an enlarged cross-sectional view of a cylindrical member of the switch device shown in FIG. 2.

The cylindrical member 7 comprises a small diameter cylinder section 7*a* that is fitted into the small diameter hole section 11*a* of the through hole 11 and projects into the wristwatch case 1, and a large diameter cylinder section 7*b* that is fitted into the large diameter hole section 11*b* of the through hole 11 and projects to the outside of the wristwatch case 1, as shown in FIG. 2 and FIG. 5. The small diameter cylinder section 7*a* of the cylindrical member 7 is placed into the small diameter hole section 11*a* of the through hole 11 and formed in a substantially quadrangle rectangular shape. As a result, the cylindrical member 7 is attached without rotating against the wristwatch case 1 by the small diameter cylinder section 7*a* being fitted into the small diameter hole section 11*a* of the through hole 11 as shown in FIG. 2.

The place where the small diameter cylinder section 7*a* projects into the wristwatch case 1 is formed in a cylindrical shape as shown in FIG. 2. A ring attachment groove 13 is provided in the cylindrical shaped portion of the small diameter cylinder section 7*a*. A detachment prevention ring 12, such as an E ring, is attached to the ring attachment groove 13. Therefore, the cylindrical member 7 is attached in the through hole 11 of the wristwatch case 1 by the detachment prevention ring 12 without slipping to the exterior of the wristwatch case 1.

A plurality of gasket grooves 15 (packing grooves) are provided on the outer peripheral surface of the portion of the large diameter cylinder section 7*b* of the cylindrical member 7 positioned in the through hole 11, as shown in FIG. 2 and FIG. 5. A waterproof gasket 14 is attached to each of the plurality of gasket grooves 15. A flange section 16 that comes in contact with the outer surface of the wristwatch case 1 is provided on the outer peripheral surface of the place where the large diameter cylinder section 7*b* projects outward from the wristwatch case 1. The flange section 16 of the large diameter cylinder section 7*b* comes in contact with the outer surface of the wristwatch case 1 and the detachment prevention ring 12 of the small diameter cylinder section 7*a* comes in contact with the inner surface of the wristwatch case 1. In this manner, the directional movement of the cylindrical member 7 relative to the wristwatch case 1 is restricted.

Furthermore, a pair of release grooves 17 are provided along the axial direction on the outer peripheral surface of the large diameter cylinder section 7*b* positioned further towards the outer side of the wristwatch case 1 than the flange section 16, as shown in FIG. 2 to FIG. 6. A pair of spring lock grooves 18 are provided along the axial direction on the outer peripheral surface of the large diameter cylinder section 7*b* in positions where circumferential direction differs relative to the pair of release grooves 17. Detachment prevention restricting projected sections 19 are also circularly and intermittently provided in the outer end portion of the outer peripheral surface of the large diameter cylinder section 7*b* positioned on the outer side of the wristwatch case 1, excluding the positions in which the release grooves 17 and the spring lock grooves 18 are positioned.

Figure 6:
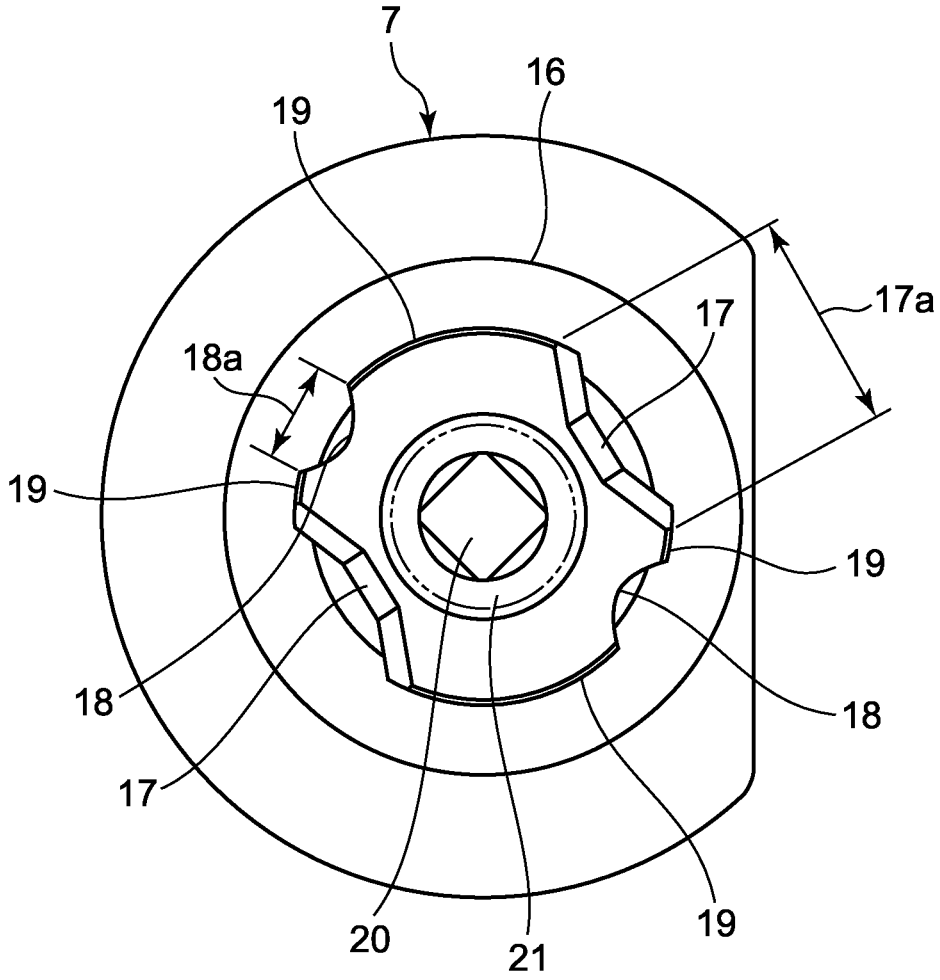
FIG. 6 is an enlarged side view of the cylindrical member shown in FIG. 5 when viewed from the right side.

The pair of release grooves 17 are formed in two positions positioned on the upper right and the lower left of the outer peripheral surface of the large diameter cylinder section 7*b* projecting outward from the wristwatch case 1, in a manner to be open from the flange section 16 to the outer end portion (right end portion in FIG. 5), as shown in FIG. 5 and FIG. 6. In addition, the pair of spring lock grooves 18 are formed in two positions positioned on the upper left and the lower right of the outer peripheral surface of the large diameter cylinder section 7*b* projecting outward from the wristwatch case 1, in a manner to be open from the flange section 16 to the outer end portion (right end portion in FIG. 5).

In this structure, the pair of release grooves 17 are formed to be substantially equal in depth to the pair of spring lock grooves 18, as shown in FIG. 6. In addition, a groove width 17*a*, which is the length in the radial direction of the pair of release grooves 17, is formed to be sufficiently longer than a groove width 18*a* of the pair of spring lock grooves 18. Furthermore, the detachment prevention restricting projected sections 19 are formed such that an outer surface 19*a* (right side surface in FIG. 5) positioned on the outer side of the wristwatch case 1 and an inner surface 19*b* (left side surface in FIG. 5) positioned on the inner side of the wristwatch case 1 are formed on vertical planes perpendicular to the axial direction, as shown in FIG. 5 and FIG. 6.

A small diameter hole section 20 provided in the small diameter cylinder section 7*a* and a large diameter hole section 21 provided in the large diameter cylinder section 7*b* are provided within the cylindrical member 7, as shown in FIG. 2 and FIG. 5. In this structure, the winding stem 6 is inserted into the small diameter hole section 20, and an operating shaft section 24 of the operating member 8, described hereafter, is inserted into the large diameter hole section 21, as shown in FIG. 2. A plurality of gasket grooves 22 are provided on the inner peripheral surface of the large diameter hole section 21, and the waterproofing gasket 14 is attached to each of the plurality of gasket grooves 22.

Figure 7:
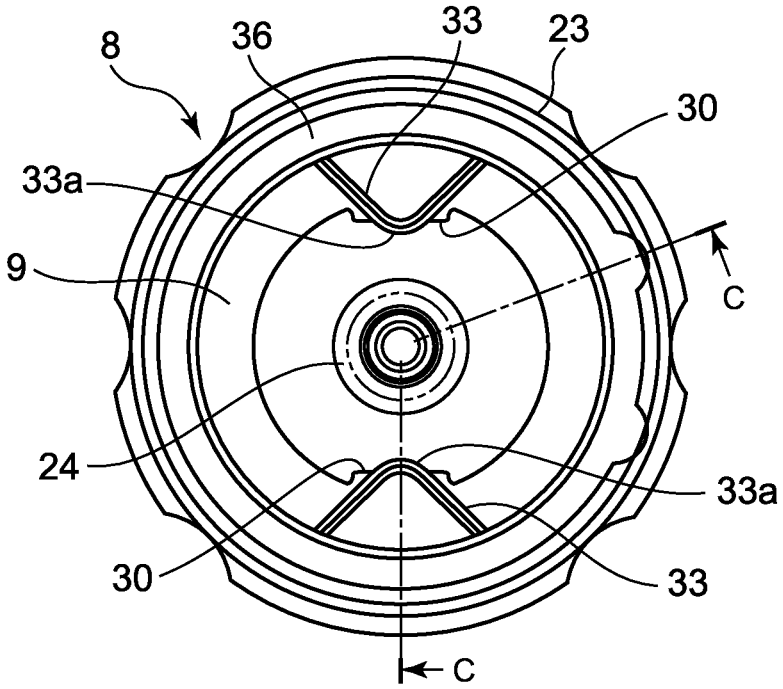
FIG. 7 is an enlarged side view of the operating member of the switch device shown in FIG. 2 when viewed from the left side.
Figure 8:
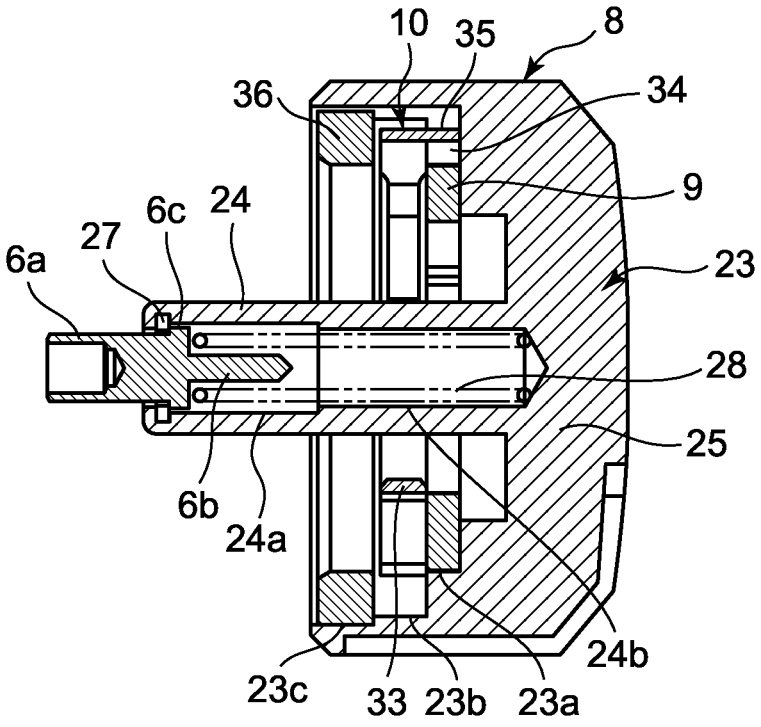
FIG. 8 is an enlarged cross-sectional view of main section of the operating member taken along line C-C in FIG. 7.

The operating member 8 includes an operating section 23 that is formed in a circular tube shape with a slightly larger diameter than the outer diameter of the flange section 16 of the cylindrical member 7, and the operating shaft section 24 that is formed in a circular tube shape with a slightly smaller diameter than the inner diameter of the large diameter cylinder section 7*b* of the cylindrical member 7, as shown in FIG. 2, FIG. 7, and FIG. 8. The interior of the operating section 23 is formed into a hollow shape, as shown in FIG. 9B.

In other words, the interior of the operating section 23 is formed into a hollow shape with a plurality of diameters which are stepwise smaller than the outer diameter of the flange section 16 of the cylindrical member 7, as shown in FIG. 2. The axial length (depth) of the interior is formed slightly longer than the length of the portion of the large diameter cylinder section 7*b* of the cylindrical member 7 projecting outward from the wristwatch case 1, or in other words, the length from the flange section 16 to the outer end portion.

Figure 9A:
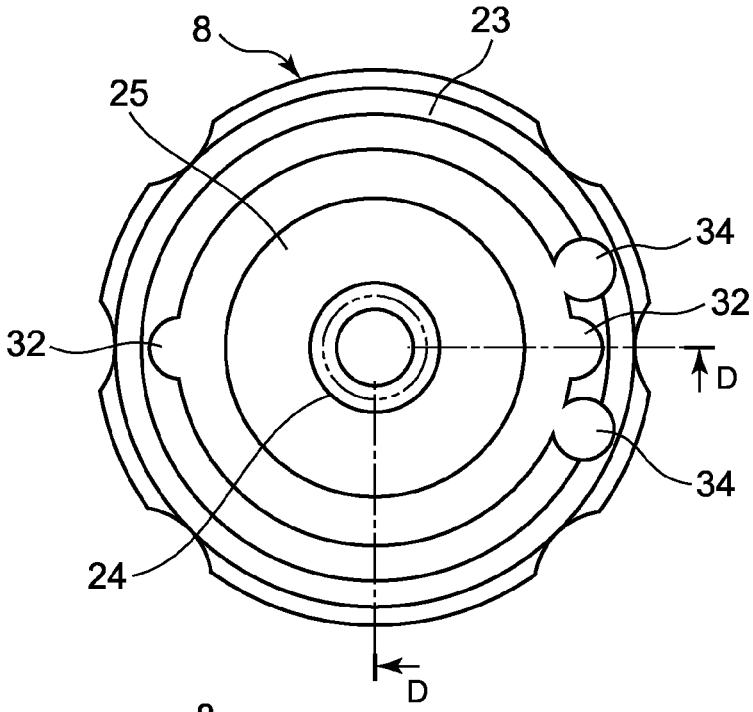
Figure 9B:
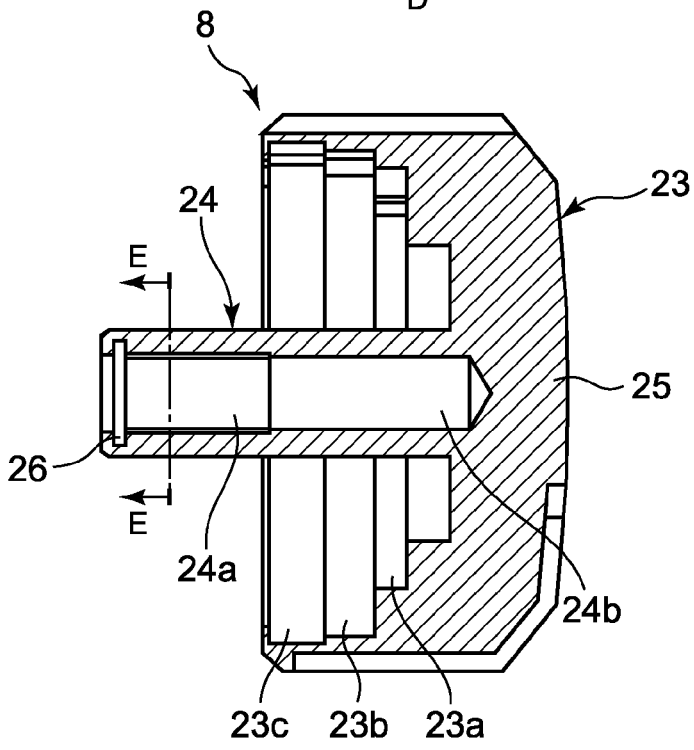

A crown wall section 25 is provided in the outer end portion of the operating section 23 positioned on the outer side of the wristwatch case 1, as shown in FIG. 2, FIG. 9A, and FIG. 9B. The operating shaft section 24 is provided projecting towards the wristwatch case 1 side in the center portion of the inner surface of the crown wall section 25. The operating shaft section 24 is inserted into the large diameter hole section 21 provided in the large diameter cylinder section 7*b* of the cylindrical member 7 and is formed to be substantially equal in length to the large diameter hole section 21 of the large diameter cylinder section 7*b* of the cylindrical member 7, as shown in FIG. 2.

Figure 9C:
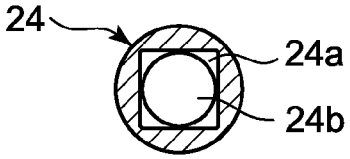

As a result, the operating shaft section 24 is formed to project from the cylindrical operating section 23 towards the wristwatch case 1 side by an amount equivalent to the length of the portion of the large diameter cylinder section 7*b* of the cylindrical member 7 inserted into the through hole 11 of the wristwatch case 1, as shown in FIG. 2. A square hole section 24*a* with a square cross-sectional shape that is provided in the position projecting from the operating section 23, and a circular hole section 24*b* with a circular cross-sectional shape that is provided nearer to the operating section 23 side than the square hole section 24*a*, formed continuously with the square hole section 24*a*, and inscribed to the inner surface of the square hole section 24*a*, are provided along the axial direction in the operating shaft section 24, as shown in FIG. 9A to FIG. 9C.

In this structure, a ring attachment groove 26 is provided on the inner peripheral surface of the end portion of the square hole section 24*a* of the operating shaft section 24 positioned on the inner side of the wristwatch case 1, as shown in FIG. 8 and FIG. 9B. A stopper guide ring 27 is attached to the ring attachment groove 26. A square hole that is slightly smaller than the square hole section 24*a* is provided in the center of the guide ring 27. The inner edge of the square hole projects slightly into the square hole section 24*a*.

An end portion positioned on the outer side of the winding stem 6 is attached to the operating shaft section 24, as shown in FIG. 2 and FIG. 8. In other words, the end portion of the winding stem 6 includes an interlocking shaft section 6*a* in a square bar shape movably inserted into the square hole section 24*a* of the operating shaft section 24, or in other words, into the square hole of the guide ring 27, by being provided in the tip portion of the winding stem 6 that passes through the small diameter hole section 20 into the cylindrical member 7 and a guide shaft section 6*b* movably inserted into the circular hole section 24*b* of the operating shaft section 24 by being provided at the tip of the interlocking shaft section 6*a*.

In this structure, a stopper section 6*c* is provided projecting towards the outer peripheral side on the outer peripheral surface of the end portion of the interlocking shaft section 6*a* positioned on the tip side of the winding stem 6, as shown in FIG. 2 and FIG. 8. The inner edge portion of the square hole in the guide ring 27 projecting into the square hole section 24*a* comes in contact with the stopper section 6*c*, as shown in FIG. 8, whereby the operating member 8 is prevented from slipping out towards the outer side of the wristwatch case 1.

The diameter of guide shaft section 6*b* of the winding stem 6 is formed to be sufficiently thinner than the inner diameter of the circular hole section 24*b*, as shown in FIG. 2 and FIG. 8. A coil spring 28 is arranged between the outer peripheral surface of the guide shaft section 6*b* and the inner peripheral surface of the circular hole section 24*b*. The coil spring 28 is configured such that one end portion is in resilient contact with the end surface of the interlocking shaft section 6*a* of the winding stem 6 and the other end portion is in resilient contact with the rear portion (right end portion in FIG. 8) of the circular hole section 24*b* of the operating shaft section 24, as shown in FIG. 2 and FIG. 8. In this state, the coil spring 28 biases the operating shaft section 24 in the direction where the operating shaft section 24 is pushed outward from within the cylindrical member 7.

Accordingly, when the operating section 23 of the operating member 8 is pushed inward against the spring force of the coil spring 28, the interlocking shaft section 6*a* of the winding stem 6 is relatively pushed inward into the square hole section 24*a* of the operating shaft section 24 and the guide shaft section 6*b* of the winding stem 6 is also relatively pushed inward into the circular hole section 24*b* of the operating shaft section 24 by the coil spring 28 being compressed. As a result, the operating section 23 comes close to the wristwatch case 1 as shown in FIG. 2.

Figure 15:
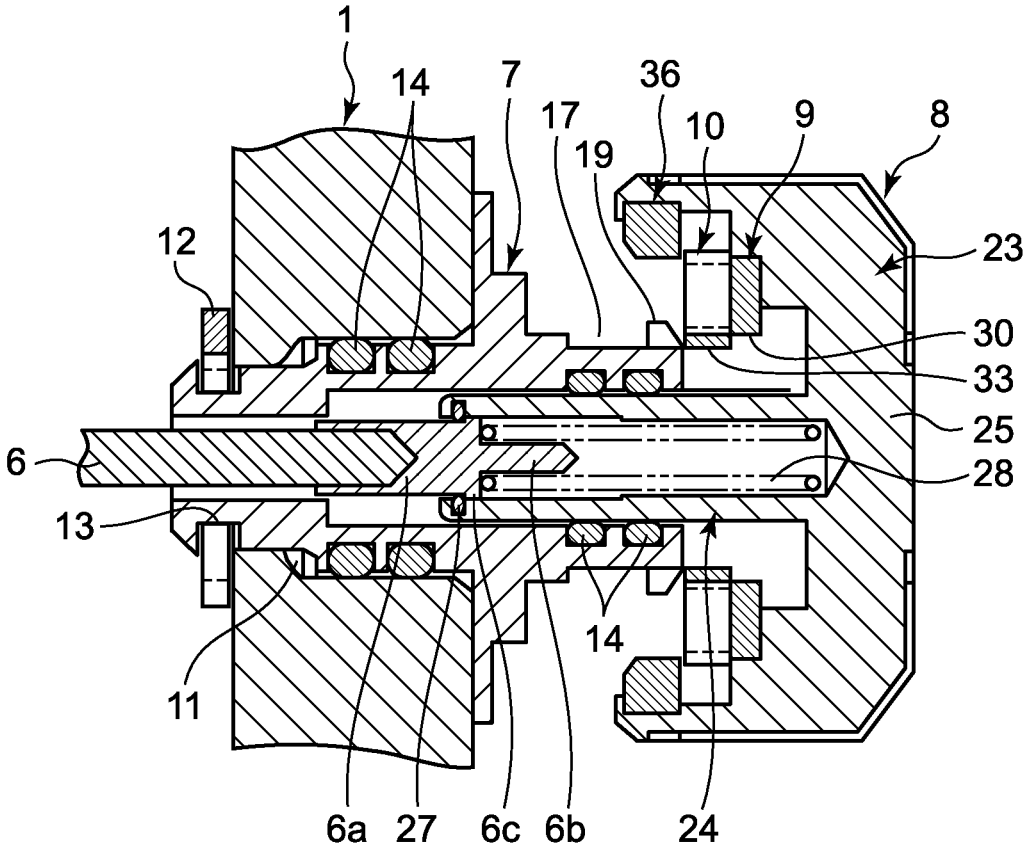
FIG. 15 is an enlarged cross-sectional view of main section of the switch device shown in FIG. 12, in which the operating member is pulled outward.

In addition, when, in the state shown in FIG. 2, external force is removed from the operating section 23 of the operating member 8 as shown in FIG. 8, the operating shaft section 24 is pushed outward in relation to the winding stem 6 by the spring force of the coil spring 28, whereby the operating section 23 moves away from the wristwatch case 1 as shown in FIG. 15.

In addition, when the operating section 23 of the operating member 8 is rotated, the operating shaft section 24 rotates with the operating section 23 regardless of the operating section 23 being pushed inward or pushed outward. Then, the rotation is transmitted to the interlocking shaft section 6*a* of the winding stem 6 inserted into the square hole section 24*a* of the operating shaft section 24, whereby the winding stem 6 is interlockingly rotated by the interlocking shaft section 6*a*, as shown in FIG. 2, FIG. 8, and FIG. 15.

On the other hand, first to third mounting groove sections 23*a* to 23*c* are formed stepwise in the operating section 23 of the operating member 8, as shown in FIG. 8 and FIG. 9B. The pressing member 9, the spring member 10, and a pressing ring 36, described hereafter, are sequentially arranged in the first to third mounting groove sections 23*a* to 23*c*, respectively. The pressing member 9 is arranged in the first mounting groove section 23*a* of the operating section 23, as shown in FIG. 2 and FIG. 8. The pressing member 9 is formed into a ring shape, as shown in FIG. 10A and FIG. 10B.

Figure 3:
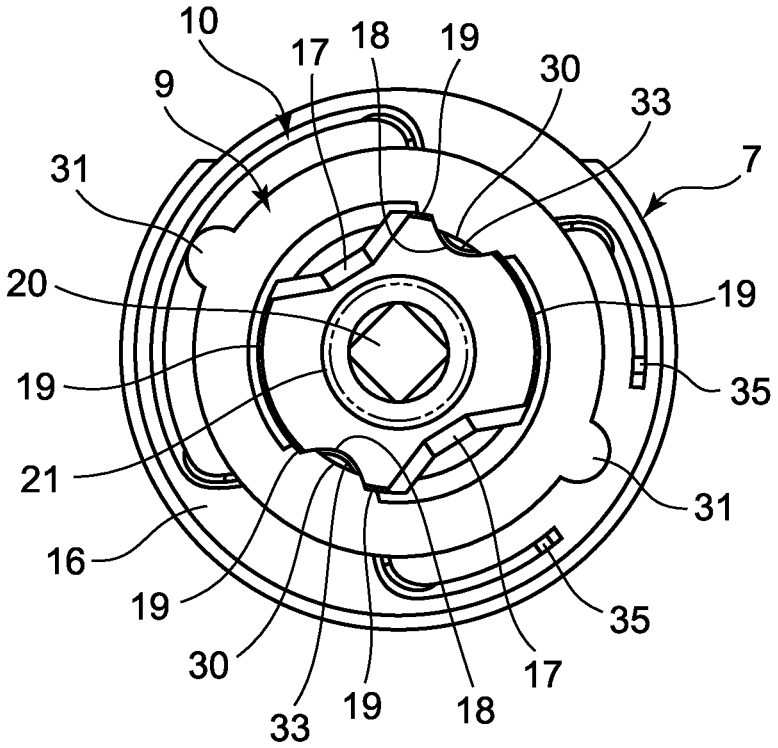
FIG. 3 is an enlarged view of main sections of a switch device taken along line B-B in FIG. 2.
Figure 13:
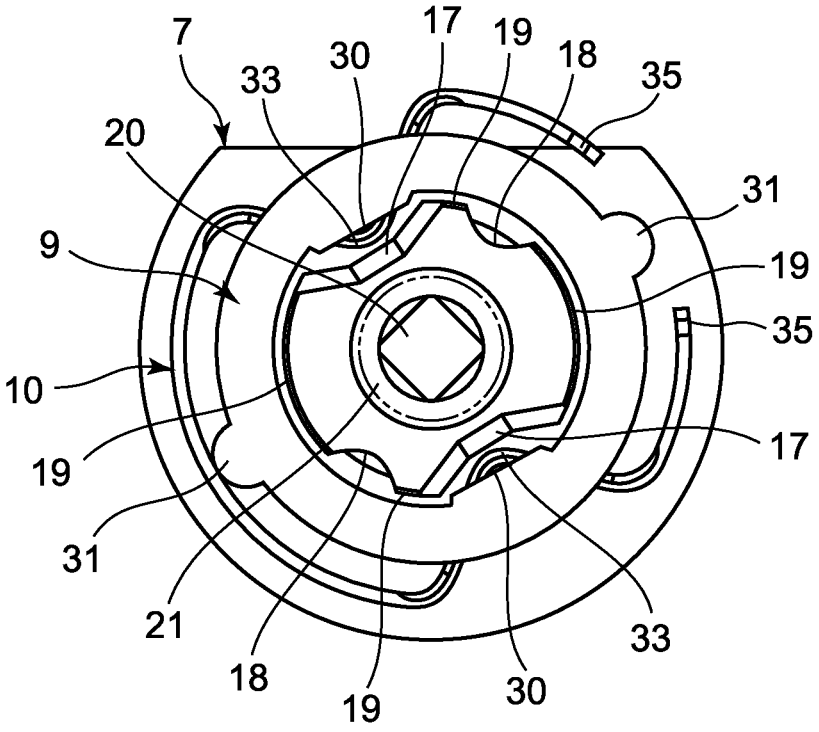
FIG. 13 is an enlarged view of main section of the switch device shown in FIG. 12, taken along line H-H.

A pair of engaging projected sections 30 projecting towards the axial center of the pressing member 9 are provided in radially opposite positions on the inner peripheral portion of the pressing member 9. The projection length 30*a* of the pair of engaging projected sections 30 is formed projecting towards the axial center of the pressing member 9 as shown in FIG. 10A, is slightly shorter than the depth of the release grooves 17 of the cylindrical member 7 as shown in FIG. 3 and FIG. 13. The length 30*b* of the pair of engaging projected sections 30 is formed in the radial direction, is shorter than the groove width 17*a* of the release grooves 17, as shown in FIG. 13, and sufficiently longer than the groove width 18*a* of the spring lock grooves 18 of the cylindrical member 7, as shown in FIG. 3.

As a result, when the pair of engaging projected sections 30 are arranged in the release grooves 17 of the cylindrical member 7, the engaging projected sections 30 move in the axial direction along the release grooves 17, whereby the pressing member 9 is detached outward from the release grooves 17, as shown in FIG. 13. In addition, when the pair of engaging projected sections 30 correspond to the spring lock grooves 18 of the cylindrical member 7, both end portions of the engaging projected sections 30 come into contact with the inner surface 19*b* of the restricting projected sections 19 positioned on both sides of the spring lock grooves 18, as shown in FIG. 3, whereby the pressing member 9 is prevented from slipping outward from the cylindrical member 7.

Figure 10A:
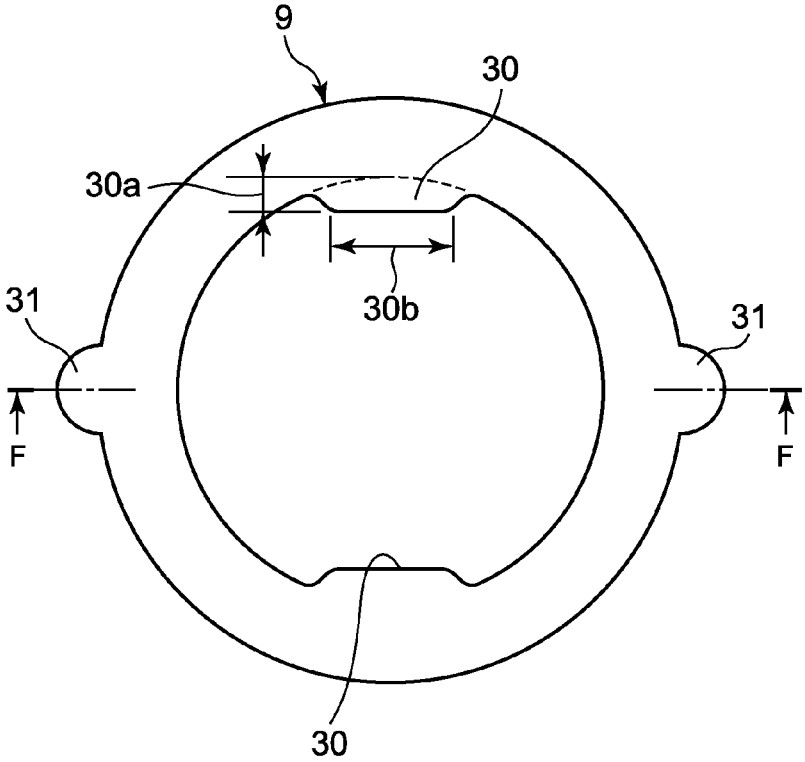
Figure 10B:
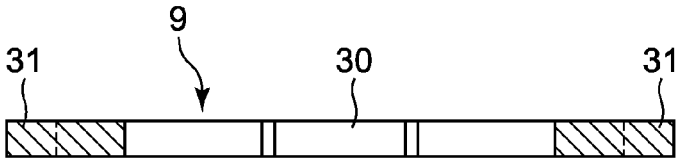

In addition, a pair of rotation restricting sections 31 are provided projecting from the outer periphery on the outer peripheral surface of the pressing member 9, as shown in FIG. 10A. The pair of rotation restricting sections 31 engage with a pair of engaging recessed sections 32 provided on the outer peripheral surface of the first mounting groove section 23*a* of the operating section 23, as shown in FIG. 9A, whereby the pressing member 9 is prevented from rotating within the first mounting groove section 23*a* of the operating section 23, and rotates with the operating section 23.

Figure 11A:
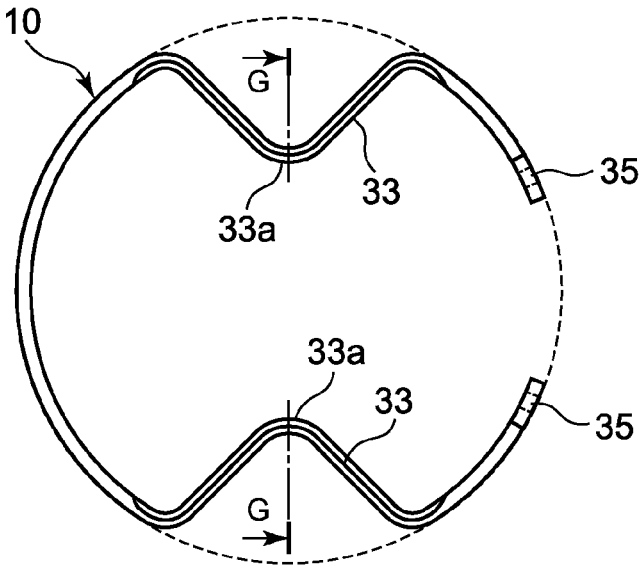
Figure 11B:
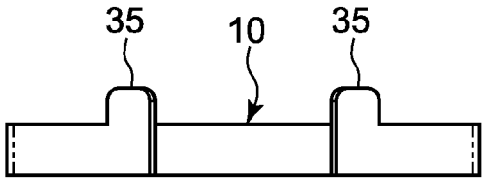
Figure 11C:
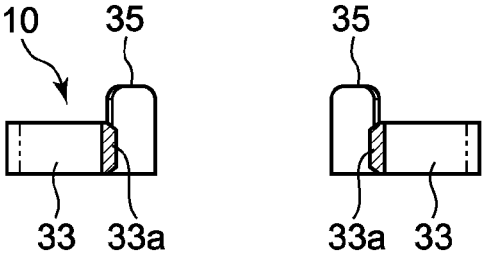

Furthermore, the spring member 10 that resiliently deforms in the radial direction is arranged in the second mounting groove section 23*b* of the operating section 23 of the operating member 8, as shown in FIG. 2 and FIG. 8. The spring member 10 is configured by a band plate curved into a substantial ring shape, as shown in FIG. 11A to FIG. 11C. A pair of resilient projected sections 33 that project towards the center of the operating section 23 and resiliently deforms are provided in the spring member 10, corresponding to the engaging projected sections 30 of the pressing member 9, as shown in FIG. 3 and FIG. 13.

Figure 4:
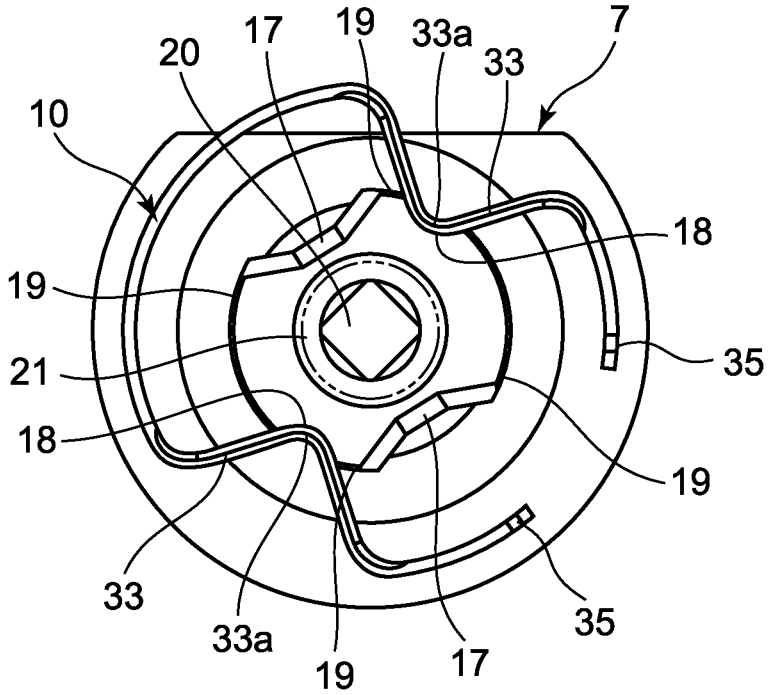
FIG. 4 is an enlarged view of main section of the switch device shown in FIG. 3, in which the pressing member is removed.

The pair of resilient projected sections 33 are provided opposite to each other and bent into a V shape at a substantially 90 degree angle, as shown in FIG. 4 and FIG. 11A, and thereby rotate and move in a state where respective tip sections 33*a* opposite each other are in resilient contact with the outer peripheral surface of the portion of the large diameter cylinder section 7*b* of the cylindrical member 7 projecting outward from the wristwatch case 1. In this structure, the pair of resilient projected sections 33 are configured such that the angle of the V shape resiliently changes when rotating and moving along the outer peripheral surface of the large diameter cylinder section 7*b* of the cylindrical member 7.

Figure 14:
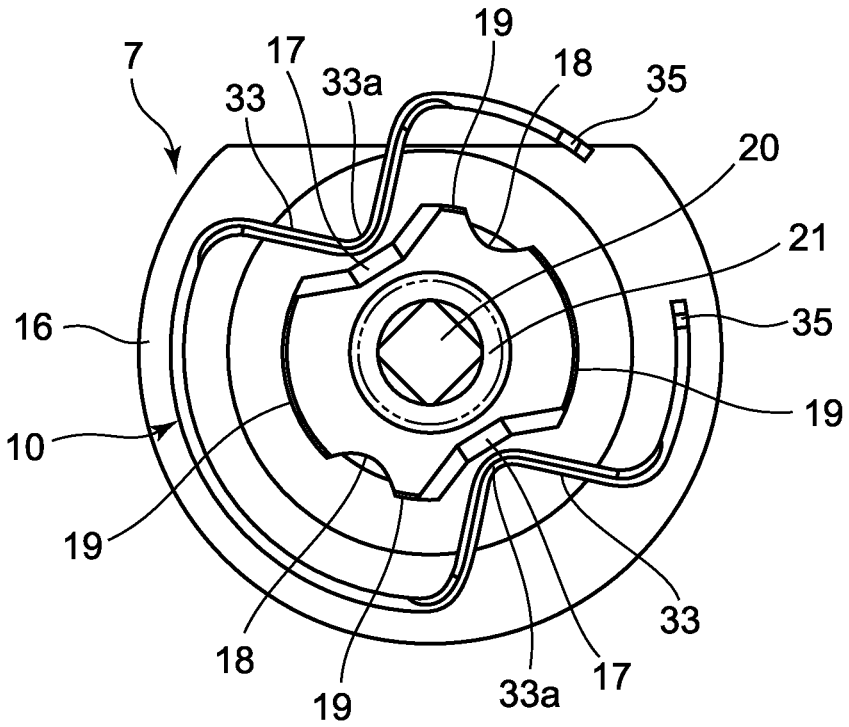
FIG. 14 is an enlarged view of main section of the switch device shown in FIG. 13, in which the pressing member is removed.

As a result, when the pair of resilient projected sections 33 rotate and move with respective tip sections 33*a* opposite each other being in resilient contact with the outer peripheral surface of the large diameter cylinder section 7*b* of the cylindrical member 7, the pair of resilient projected sections 33 resiliently engage with the pair of release grooves 17 and the pair of spring lock grooves 18 provided on the outer peripheral surface of the large diameter cylinder section 7*b* of the cylindrical member 7, as shown in FIG. 4 and FIG. 14, thereby engaging with the release grooves 17 and the spring lock grooves 18 with a click feeling.

A pair of hook sections 35 are also provided on both end portions of the spring member 10 configured by the band plate curved into a substantial ring shape, as shown in FIG. 9 and FIG. 11A to FIG. 11C. The pair of hook sections 35 engage with a pair of locking recessed sections 34 provided in the corresponding positions of the first mounting groove section 23*a* of the operating section 23 and prevent rotation in relation to the operating section 23. In this structure, the pair of locking recessed sections 34 are provided on the outer peripheral side of the first mounting groove section 23*a* of the operating section 23 in a manner to be positioned on both sides of the engaging recessed section 32 with which the rotation restricting section 31 on the outer periphery of the pressing member 9 engages, as shown in FIG. 9A.

When the spring member 10 is placed in the second mounting groove section 23*b* of the operating section 23 in a state of being pushed against the pressing member 9, the pair of hook sections 35 project towards the outer peripheral side (right side in FIG. 8) of the pressing member 9 and thereby are inserted into the locking recessed sections 34 provided in the corresponding positions of the first mounting groove section 23*a*, as shown in FIG. 8 and FIG. 11A to FIG. 11C, whereby the position of the spring member 10 in the rotation direction is restricted.

As a result, the position of the spring member 10 in the rotation direction is restricted in the second mounting groove section 23*b* of the operating section 23, as shown in FIG. 8. In this state, the spring member 10 rotates integrally with the operating section 23. In addition, the spring member 10 is pressed so as not to slip out from within the operating section 23 by the pressing ring 36 arranged in the third mounting groove section 23*c* of the operating section 23, as shown in FIG. 8.

The winding stem. 6 that is connected to the operating member 8 is arranged such that the winding stem 6 projects into the timepiece module 4 provided in the wristwatch case 1, as shown in FIG. 2. In order that the winding stem 6 is locked in a state of being pushed in, the operating section 23 of the operating member 8 is pushed inward. Then, the resilient projected sections 33 of the spring member 10 engage with the spring lock grooves 18 of the cylindrical member 7. And then, the engaging projected sections 30 of the pressing member 9 come in contact with the restricting projected sections 19 of the cylindrical member 7.

In addition, the winding stem 6 maintains the state of being pushed in, and the switch of the timepiece module 4 does not operate even when the engaging projected sections 30 of the pressing member 9 are released from being locked by being detached from the release grooves 17 of the cylindrical member 7, and then the operating section 23 of the operating member 8 is pushed outward by the spring force of the coil spring 28, as shown in FIG. 15.

Furthermore, when the operating section 23 of the operating member 8 is further pulled outward in the state shown in FIG. 15, the winding stem 6 moves in the direction where the winding stem 6 is pulled out in response to the pull-out operation of the operating section 23 (not shown). As a result, the operating mode switches an ordinary timepiece mode to a time adjustment mode. When the operating section 23 is rotated in this state, the winding stem 6 rotates in response to the rotation, and time adjustment is performed based on the rotation.

Next, the mechanism of the above-described switch device 5 of a wristwatch will be described.

In order that the switch device 5 is used, the operating section 23 of the operating member 8 is rotated in the state shown in FIG. 2. Then, the pressing member 9 and the spring member 10 rotate in response to the rotation of the operating section 23, whereby the operating member 8 is released from being locked.

In other words, the position of the pressing member 9 is restricted by that the rotation restricting sections 31 of the pressing member 9 is locked by the engaging recessed sections 32 in the first mounting groove section 23*a* of the operating section 23, as shown in FIG. 3 and FIG. 4. The position of the spring member 10 is also restricted by that the hook sections 35 of the spring member 10 are inserted into the locking recessed sections 34 provided in the corresponding positions of the first mounting groove section 23*a* of the operating section 23. Therefore, when the operating section 23 rotates, the pressing member 9 and the spring member 10 rotate in response to the rotation.

When the spring member 10 rotates with the operating section 23 as described above, the resilient projected sections 33 of the spring member 10 are detached from the spring lock grooves 18 of the large diameter cylinder section 7*b* of the cylindrical member 7 while resiliently deforming, and then the tip sections 33*a* of the resilient projected sections 33 rotate and move along the outer peripheral surface of the large diameter cylinder section 7*b* of the cylindrical member 7, as shown in FIG. 3 and FIG. 4. At this time, in a state where movement to the outer side is restricted by that the engaging projected sections 30 of the pressing member 9 corresponding to the resilient projected sections 33 are in contact with the inner surface 19*b* of the restricting projected sections 19 in the large diameter cylinder section 7*b* of the cylindrical member 7, the engaging projected sections 30 of the pressing member 9 move away in the circumferential direction from the positions corresponding to the spring lock grooves 18 of the cylindrical member 7.

Figure 12:
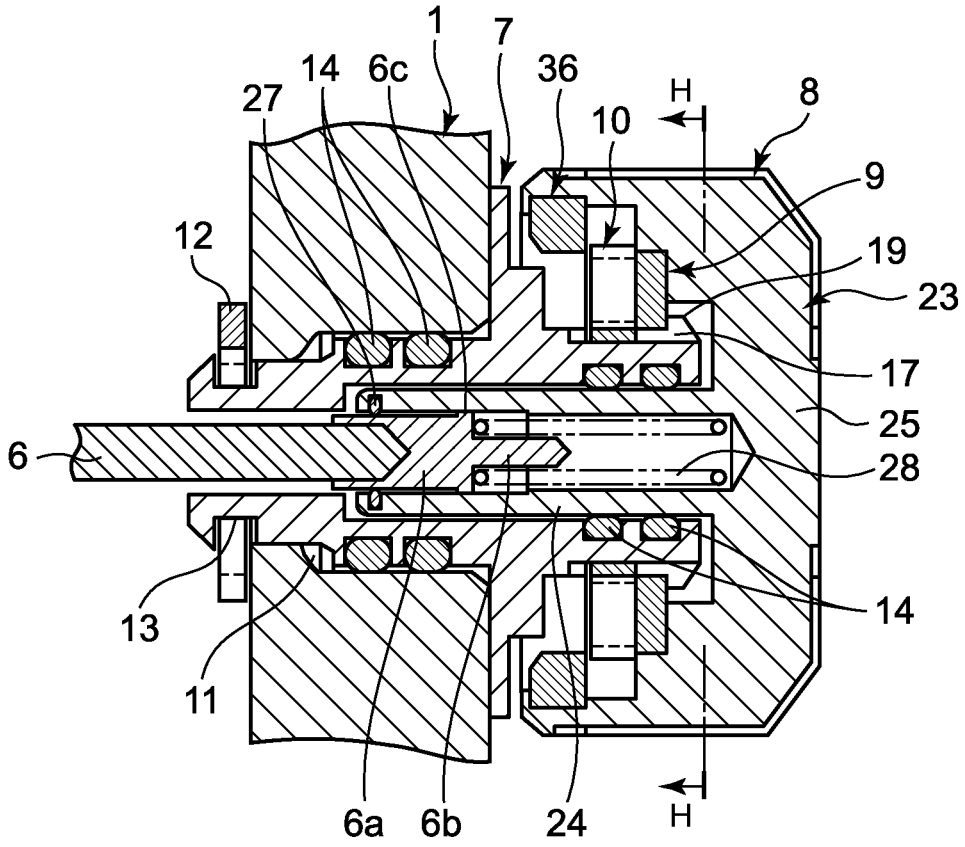
FIG. 12 is an enlarged cross-sectional view of main section of the switch device shown in FIG. 2, in which the engaging projected sections of the pressing member and the resilient projected sections of the spring member correspond to release grooves in the cylindrical member by the operating member being rotated.

Then, when the operating section 23 is further rotated, the resilient projected sections 33 of the spring member 10 engage with the release grooves 17 of the cylindrical member 7 with a click feeling while resiliently returning, as shown in FIG. 12 to FIG. 14. At this time, the engaging projected sections 30 of the pressing member 9 corresponding to the resilient projected sections 33 also move to the positions corresponding to the release grooves 17 of the cylindrical member 7 and thereby move away in the circumferential direction from the inner surface 19*b* of the restricting projected sections 19 of the cylindrical member 7.

As a result, the operating member 8 is released from being locked, whereby the operating shaft section 24 of the operating member 8 is pushed towards the outer side of the wristwatch case 1 by the spring force of the coil spring 28 of the operating member 8, as shown in FIG. 15. Then, the engaging projected sections 30 of the pressing member 9 and the resilient projected sections 33 of the spring member 10 move in the axial direction along the release grooves 17 of the cylindrical member 7. Therefore, the engaging projected sections 30 of the pressing member 9 and the resilient projected sections 33 of the spring member 10 are detached from the release grooves 17 by moving to the outer side of the detachment prevention restricting projected sections 19.

At this time, the winding stem 6 does not move in the axial direction. In addition, even when the winding stem 6 is rotated by the operating section 23 being rotated in this state, the switch of the timepiece module 4 does not operate. When the operating section 23 is pulled further outward, the winding stem 6 is pulled outward. At this time, as a result of the pull-out operation of the winding stem 6, the switch of the timepiece module 4 operates, whereby the operating mode switches from the ordinary timepiece mode to the time adjustment mode. When the operating section 23 is rotated in this state, the winding stem 6 rotates in response to the rotation, whereby time adjustment is performed based on the rotation.

On the other hand, when the switch device 5 is not used, the operating section 23 of the operating member 8 comes close to the outer surface of the wristwatch case 1 by being pushed inward against the spring force of the coil spring 28 in the state shown in FIG. 15. Then, the resilient projected sections 33 of the spring member 10 come into contact with the outer surface 19*a* of the restricting projected sections 19 of the cylindrical member 7. In this state, the operating section 23 is rotated while being pushed against the spring force of the coil spring 28, whereby the resilient projected sections 33 of the spring member 10 and the engaging projected sections 30 of the pressing member 9 correspond to the release grooves 17 of the cylindrical member 7 as shown in FIG. 13.

Then, when the operating section 23 is further pushed inward against the spring force of the coil spring 28 in the state where the resilient projected sections 33 of the spring member 10 and the engaging projected sections 30 of the pressing member 9 correspond to the release grooves 17 of the cylindrical member 7, the resilient projected sections 33 of the spring member 10 and the engaging projected sections 30 of the pressing member 9 move along the release grooves 17 of the cylindrical member 7. Therefore, the operating section 23 comes close to the outer surface of the wristwatch case 1 by that the resilient projected sections 33 of the spring member 10 and the engaging projected sections 30 of the pressing member 9 pass through the corresponding positions of the restricting projected sections 19 of the cylindrical member 7 and then become positioned on the outer periphery of the large diameter cylinder section 7*b* of the cylindrical member 7, as shown in FIG. 12 to FIG. 14.

When the operating member 23 is rotated in this state, the resilient projected sections 33 of the spring member 10 are detached from the release grooves 17 of the cylindrical member 7 while resiliently deforming, and then the tip sections 33*a* of the resilient projected sections 33 rotate along the outer peripheral surface of the large diameter cylinder section 7*b* of the cylindrical member 7. At this time, the engaging projected sections 30 of the pressing member 9 corresponding to the resilient projected sections 33 move away from the release grooves 17 of the cylindrical member 7 and then move along the inner surface 19*b* of the restricting projected sections 19 in the large diameter cylinder section 7*b*, as shown in FIG. 12 to FIG. 14.

Subsequently, when the operating section 23 is further rotated, the resilient projected sections 33 of the spring member 10 engage with the spring lock grooves 18 of the cylindrical member 7 with a click feeling while resiliently returning, as shown in FIG. 3 and FIG. 4. At this time, the engaging projected sections 30 of the pressing member 9 corresponding to the resilient projected sections 33 move to the positions corresponding to the spring lock grooves 18 of the cylindrical member 7.

In this state, the engaging projected sections 30 of the pressing member 9 are pressed against the inner surface 19*b* of the restricting projected sections 19 of the cylindrical member 7 by the spring force of the coil spring 28 of the operating member 8. As a result, the operating member 8 is locked in a state of being pushed in. In this state, the resilient projected sections 33 of the spring member 10 resiliently engage with the spring lock grooves 18 of the cylindrical member 7. As a result, the rotation of the operating member 8 can be resiliently restricted by the spring force of the spring member 10, whereby the operating section 23 is not inadvertently rotated.

As described above, the switch device 5 includes the cylindrical member 7 attached to the through hole 11 in the wristwatch case 1, and the operating member 8 having the operating shaft section 24 inserted into the cylindrical member 7 and the operating section 23 in the outer end portion. The engaging projected sections 30 projecting towards the axial center are provided in the operating member 8. In addition, the spring member 10 that resiliently deforms in the radial direction is attached to the operating member 8. The release grooves 17 in which the engaging projected sections 30 can move in the axial direction, and the restricting projected sections 19 which is formed in positions where circumferential direction differs relative to the release grooves 17 and thereby restricts the movement in the outer direction of the engaging projected sections 30 are provided in the end portion of the cylindrical member 7 in the outer direction. The spring lock grooves 18 that lock the spring member 10 when the operating member 8 is in the position in which the movement of the engaging projected sections 30 in the outer direction is restricted by the restricting projected sections 19 are formed in the cylindrical member 7. Therefore, lock release operation and lock operation of the operating member 8 can be facilitated, and inadvertent rotation of the operating member 8 in a locked state can be prevented.

In other words, in the switch device 5 of a wristwatch, the spring lock grooves 18 that lock the spring member 10 when the operating member 8 is in the locked state in the position in which the movement of the engaging projected sections 30 in the outer direction is restricted by the restricting projected sections 19 are formed in the cylindrical member 7. Therefore, when the operating member 8 is in the locked state, the rotation of the operating member 8 can be resiliently restricted by the spring force of the spring member 10. As a result, inadvertent rotation of the operating section 23 can be prevented, and the operating member 8 can be favorably maintained in the locked state.

In addition, in the switch device 5, in order that the operating member 8 is released from being locked and pulled outward, the engaging projected sections 30 provided in the operating section 23 correspond to the release grooves 17 provided on the outer peripheral surface of the cylindrical member 7 by that the operating section 23 of the operating member 8 is rotated against the spring force of the spring member 10 provided in the operating section 23. As a result, the restriction on the engaging projected sections 30 of the operating section 23 by the restricting projected sections 19 provided on the outer peripheral surface of the cylindrical member 7 can be released and the engaging projected sections 30 of the operating section 23 can be moved in the axial direction of the cylindrical member 7 along the release grooves 17 of the cylindrical member 7. Therefore, the operating member 8 can be easily released from being locked, and easily and favorably pulled out.

At this time, in order that the operating section 23 is rotated, the operating section 23 is rotated against the spring force of the spring member 10 provided in the operating section 23. As a result, locking of the spring member 10 in relation to the spring lock grooves 18 provided on the outer peripheral surface of the cylindrical member 7 can be released, and then the spring member 10 can be resiliently engaged with the release grooves 17 of the cylindrical member 7. Therefore, click feeling is imparted to the operating section 23 by the spring force of the spring member 10 when the spring member 10 engages with the release grooves 17 of the cylindrical member 7. As a result, the rotation position of the operating section 23 can be confirmed without reliance on sight, whereby the lock release of the operating member 8 can be confirmed.

In addition, in the switch device 5 of a wristwatch, in order that the operating member 8 is pushed inward and locked, the engaging projected sections 30 provided in the operating section 23 of the operating member 8 correspond to the release grooves 17 provided on the outer peripheral surface of the cylindrical member 7, and then the operating member 8 is pushed inward. As a result of the operating member 8 being rotated against the spring force of the spring member 10 in this state, the engaging projected sections 30 of the operating section 23 can correspond to the restricting projected sections 19 provided on the outer peripheral surface of the cylindrical member 7. As a result, the engaging projected sections 30 of the operating section 23 can be placed in contact with the inner side of the restricting projected sections 19 of the cylindrical member 7, thereby restricting movement to the outer side. Therefore, the operating member 8 can be easily locked.

At this time, in order that the operating section 23 is rotated, the operating section 23 is rotated against the spring force of the spring member 10. As a result, locking of the spring member 10 in relation to the release grooves 17 provided on the outer peripheral surface of the cylindrical member 7 can be released, and the spring member 10 can be resiliently engaged with the spring lock grooves 18 of the cylindrical member 7. Therefore, in this instance as well, click feeling is imparted to the operating section 23 by the spring force of the spring member 10 when the spring member 10 engages with the spring lock grooves 18 of the cylindrical member 7. As a result, the rotation position of the operating section 23 can be confirmed without reliance on sight, whereby locking of the operating member 8 can be confirmed.

As described above, in the switch device 5, the rotation of the operating member 8 is resiliently restricted by the spring force of the spring member 10. Therefore, inadvertent rotation of the operating section 23 can be prevented when the operating member 8 is in the locked state. The operating member 8 can be released from being locked by a simple operation of merely rotating the operating section 23 against the spring force of the spring member 10. In addition, the operating member 8 can be locked by a simple operation of merely rotating the operating section 23 while pushing the operating section 23 inward. Therefore, lock release operation and lock operation of the operating member 8 can be facilitated. As a result, the operating member 8 can be favorably operated even with gloved hands, such as during outdoor use. Therefore, operability of the operating member 8 can be markedly improved, and a more user-friendly wristwatch can be provided.

In addition, the switch device 5 has the pressing member 9 of a ring shape that rotates with the operating member 8. The engaging projected sections 30 are provided on the inner peripheral surface of the pressing member 9. Therefore, complicated processing is not required to be performed on the interior of the operating section 23 of the operating member 8. Moreover, the engaging projected sections 30 can be easily assembled within the operating section 23 of the operating member 8 by merely fitting the pressing member 9 of a ring shape into the operating section 23. Therefore, productivity can be enhanced.

In this instance, the pressing member 9 is arranged in the operating section 23 of the operating member 8. The rotation restricting sections 31 that engage with the engaging recessed sections 32 provided on the inner peripheral surface of the operating section 23 and prevent rotation in relation to the operating section 23 are provided in the outer peripheral portion of the pressing member 9. Therefore, when the pressing member 9 is assembled in the operating section 23, the pressing member 9 can be simply and easily attached within the operating section 23 by a simple operation of merely engaging the rotation restricting sections 31 of the pressing member 9 with the engaging recessed sections 32 in the operating section 23. As a result, the pressing member 9 can be integrally rotated with the operating section 23, and productivity can be improved.

In addition, in the switch device 5, the spring member 10 is formed into a substantial ring shape and is arranged in the operating section 23 of the operating member 8. The resilient projected sections 33 that project towards the axial center of the operating section 23 and resiliently deform are provided in the spring member 10. Therefore, a click feeling can be imparted to operating section 23 by the resilient force of the resilient projected sections 33 when the resilient projected sections 33 engage with the release grooves 17 of the cylindrical member 7 or the spring lock grooves 18 of the cylindrical member 7 by the operating section 23 being rotated. As a result, the rotation position of the operating section 23 can be favorably confirmed, whereby the lock release position and the lock position of the operating member 8 can be confirmed without relying on sight.

In this instance, the resilient projected sections 33 of the spring member 10 are provided corresponding to the engaging projected sections 30 of the pressing member 9. Therefore, the engaging projected sections 30 of the pressing member 9 can accurately and unfailingly correspond to the release grooves 17 of the cylindrical member 7 or the spring lock grooves 18 of the cylindrical member 7 when the operating section 23 is rotated and the resilient projected sections 33 are engaged with the release grooves 17 of the cylindrical member 7 or the spring lock grooves 18 of the cylindrical member 7. Therefore, lock release and locking of the operating member 8 can be reliably and favorably performed.

In addition, in the resilient projected sections 33 of the spring member 10, the tip sections 33*a* that project toward the axial center of the operating section 23 project further towards the axial center of the operating section 23 than the engaging projected sections 30 of the pressing member 9. As a result, the tip sections 33*a* of the resilient projected sections 33 can be reliably and favorably engaged with the release grooves 17 of the cylindrical member 7 or the spring lock grooves 18 of the cylindrical member 7, whereby click feeling can be unfailingly and favorably imparted to the operating section 23 by the resilient projected sections 33.

Furthermore, the hook sections 35 that engage with the locking recessed sections 34 provided in the operating section 23 of the operating member 8 and thereby prevent rotation in relation to the operating section 23 are provided in the spring member 10. Therefore, when the operating section 23 is rotated, the spring member 10 can be unfailingly rotated with the operating section 23. As a result, the tip sections 33*a* of the resilient projected sections 33 can be unfailingly and favorably engaged with the release grooves 17 of the cylindrical member 7 or the spring lock grooves 18 of the cylindrical member 7. In addition, the spring member 10 can be easily and unfailingly assembled within the operating section 23. Therefore, productivity can be improved as well.

In the above-described embodiment, the rotation restricting sections 31 are provided projecting on the outer peripheral portion of the pressing member 9, and the engaging recessed sections 32 are provided on the peripheral surface of the first mounting groove section 23*a* within the operating section 23. However, the present invention is not limited thereto. For example, the rotation restricting sections may be provided in a recessed shape on the outer peripheral portion of the pressing member 9, and the engaging sections may be provided in a projected shape on the peripheral surface of the first mounting groove section 23*a* within the operating section 23. Even though constituted in this manner, there is the same operation effect as the above-mentioned embodiment.

In addition, in the above-described embodiment, the present invention is applied to a wristwatch. However, the present invention is not necessarily required to be applied to a wristwatch and can be widely applied to various types of clocks, such as travel clocks, alarm clocks, mantelpiece clocks and wall clocks.

While the present invention has been described with reference to the preferred embodiments, it is intended that the invention be not limited by any of the details of the description therein but includes all the embodiments which fall within the scope of the appended claims.

What is claimed is:

1. A switch device comprising:

a case having a through hole;

a cylindrical member attached to the through hole of the case; and an operating member having a shaft section inserted into the cylindrical member and an operating section provided in an outer end portion of the shaft section, wherein the operating member is provided with an engaging projected section that projects towards an axial center of the operating section, and has a spring member attached that resiliently deforms in a radial direction, wherein the cylindrical member is provided with, in an end portion in an outer direction of the case, a release groove where the engaging projected section is movable in an axial direction, and a restricting projected section which is formed in a position where circumferential direction differs relative to the release groove and restricts movement to the outer direction of the engaging projected section, wherein the cylindrical member is provided with a lock groove which locks the spring member, when the operating member is in a position where movement to the outer direction of the engaging projected section is restricted by the restricting projected section.

2. The switch device according to claim 1, wherein the spring member is formed in a substantial ring shape, arranged in the operating section of the operating member, and provided with a resilient projected section that projects towards the axial center of the operating section and locks with the lock groove.

3. The switch device according to claim 1 further comprising:

a pressing member of a ring shape that rotates with the operating section of the operating member, wherein the engaging projected section is provided on an inner peripheral surface of the pressing member.

4. The switch device according to claim 3, wherein the pressing member is arranged in the operating section of the operating member, and a rotation restricting section that engages with an engaging section provided on an inner peripheral surface of the operating section and prevents rotation in relation to the operating section is provided in an outer peripheral portion of the pressing member.

5. The switch device according to claim 3, wherein the spring member is formed in a substantial ring shape, arranged in the operating section of the operating member, and provided with a resilient projected section that projects towards the axial center of the operating section and locks with the lock groove.

6. The switch device according to claim 5, wherein the resilient projected section of the spring member is provided corresponding to the engaging projected section of the pressing member.

7. The switch device according to claim 6, wherein the resilient projected section of the spring member has a tip section projecting towards the axial center of the operating section which projects further towards the axial center of the operating section than the engaging projected section of the pressing member.

8. The switch device according to claim 5, wherein the spring member includes a hook section that engages with a locking recessed section provided in the operating section of the operating member and prevents rotation in relation to the operating section.

9. A wristwatch comprising:

a wristwatch case having a through hole;

a cylindrical member attached to the through hole in the wristwatch case;

an operating member having a shaft section inserted into the cylindrical member and an operating section provided in an outer end portion of the shaft section; and a timepiece module for displaying time provided within the wristwatch case, wherein the operating member is provided with an engaging projected section that projects toward an axial center of the operating section, and has a spring member attached that resiliently deforms in a radial direction, wherein the cylindrical member is provided with, in an end portion in an outer direction of the wristwatch case, a release groove where the engaging projected section is movable in an axial direction, and a restricting projected section which is formed in a position where circumferential direction differs relative to the release groove and restricts movement of the engaging projected section in the outer direction, and wherein the cylindrical member is provided with a lock groove that locks the spring member when the operating member is in a position where movement to the outer direction of the engaging projected section is restricted by the restricting projected section.

10. The wristwatch according to claim 9, wherein the spring member is formed in a substantial ring shape, arranged in the operating section of the operating member, and provided with a resilient projected section that projects towards the axial center of the operating section and locks with the lock groove.

11. The wristwatch according to claim 9 further comprising: a pressing member of a ring shape that rotates with the operating section of the operating member, wherein the engaging projected section is provided on an inner peripheral surface of the pressing member.

12. The wristwatch according to claim 11, wherein the pressing member is arranged in the operating section of the operating member, and a rotation restricting section that engages with an engaging section provided on an inner peripheral surface of the operating section and prevents rotation in relation to the operating section is provided in an outer peripheral portion of the pressing member.

13. The wristwatch according to claim 11, wherein the spring member is formed in a substantial ring shape, arranged in the operating section of the operating member, and provided with a resilient projected section that projects towards the axial center of the operating section and locks with the lock groove.

14. The wristwatch according to claim 13, wherein the resilient projected section of the spring member is provided corresponding to the engaging projected section of the pressing member.

15. The wristwatch according to claim 14, wherein the resilient projected section of the spring member has a tip section projecting towards the axial center of the operating section which projects further towards the axial center of the operating section than the engaging projected section of the pressing member.

16. The wristwatch according to claim 13, wherein the spring member includes a hook section that engages with a locking recessed section provided in the operating section of the operating member and prevents rotation in relation to the operating section.

* * * * *